US006756352B2

(12) United States Patent
Makansi

(10) Patent No.: US 6,756,352 B2
(45) Date of Patent: Jun. 29, 2004

(54) REMOVING STUBBORN MILDEW STAIN

(75) Inventor: Munzer Makansi, Signal Mountain, TN (US)

(73) Assignee: Fiber Engineering, Inc., Signal Mountain, TN (US)

( * ) Notice: Subject to any disclaimer, the term of this patent is extended or adjusted under 35 U.S.C. 154(b) by 0 days.

(21) Appl. No.: 10/402,169

(22) Filed: Mar. 28, 2003

(65) Prior Publication Data

US 2003/0186827 A1 Oct. 2, 2003

Related U.S. Application Data

(60) Provisional application No. 60/369,366, filed on Apr. 1, 2002.

(51) Int. Cl.[7] ..... C11D 3/00; C11D 7/18; C11D 7/54

(52) U.S. Cl. ..... 510/370; 510/380

(58) Field of Search ..... 510/370, 380

(56) References Cited

U.S. PATENT DOCUMENTS 3,172,861 A * 3/1965 Steinhauer et al. ..... 252/187
4,071,463 A 1/1978 Steinhauer
4,337,163 A 6/1982 Schilp
4,800,036 A 1/1989 Rose et al.
4,889,654 A * 12/1989 Mason et al. ..... 252/100
4,898,681 A 2/1990 Burton
4,900,467 A 2/1990 Smith
5,281,280 A 1/1994 Lisowski et al.
5,290,470 A 3/1994 Dutcher et al.
5,549,842 A 8/1996 Chang
5,567,247 A 10/1996 Hawes

* cited by examiner

*Primary Examiner*—Yogendra N. Gupta
(74) *Attorney, Agent, or Firm*—Todd Deveau; Thomas, Kayden, Horstemeyer & Risley LLP

(57) ABSTRACT

An aqueous cleaning composition fluid foam containing an alkali metal hypochlorite has a particular combination of precursor solution relative viscosity, foam syneresis value, foam horizontal thickness half-life and foam vertical wall clingability, and compared to known hypochlorite-containing cleaning compositions, provides superior cleaning of stubborn mildew, normally without scrubbing. The cleaning composition fluid foam is produced by vigorous agitation of an aqueous hypochlorite solution containing an alkaline builder and a surfactant in the presence of a gas, or by injection of a pressurized propellant into an aerosol dispenser containing such solution and then passing the solution/propellant mix through a mechanical break-up actuator in the valve assembly of the aerosol dispenser.

12 Claims, 2 Drawing Sheets

REMOVING STUBBORN MILDEW STAIN

CROSS-REFERENCE TO RELATED APPLICATION

This application claims right of priority under 35 USC 119(3)(e) from provisional application No. 60/369,366 filed Apr. 1, 2002

BACKGROUND OF THE INVENTION

1. Field of the Invention

This invention relates to a cleaning composition for removing stubborn mildew and other mycological stains from surfaces, the cleaning composition comprising an aqueous solution of an alkali metal hypochlorite, an alkaline builder, and a hypochlorite-compatible surfactant. More particularly, the invention concerns such a cleaning composition which is fluid foam having a particular combination of characteristics and a process for preparing the cleaning composition fluid foam.

2. Description of the Prior Art

Various aqueous mildew-removing products are available commercially for home use. Typically, the aqueous products contain a metal hypochlorite, an alkaline builder for maintaining the aqueous product at a pH of at least 11, and a surfactant. Such products typically are dispensed from plastic bottles equipped with hand-activated pumps for spraying the cleaner on a surface. The sprayed cleaning compositions usually are dispensed as liquids, short-lived foams, thickened liquids or gels.

Several aqueous alkali metal hypochlorite compositions for the removal of mildew stains, similar to those in the commercial products, are disclosed in patents, such as U.S. Pat. No. 5,281,280 (Lisowski et al), U.S. Pat. No. 5,290,470 (Dutcher et al), and U.S. Pat. No. 5,567,247 (Hawes). The present inventor found that although some of the known cleaning compositions remove mildew stains of mild intensity, none of the tested commercial products could remove long established, stubborn mildew stains unless cleaning was accompanied by vigorous scrubbing. In addition, almost all of the tested products lost cleaning efficiency with aging during storage.

The use of thickening agents to increase viscosity and change flow characteristics of aqueous hypochlorite-containing cleaning compositions in order to improve their cleaning ability is disclosed in various patents, as for example in U.S. Pat. No. 5,549,842 (Chang), U.S. Pat. No. 4,900,467 (Smith), U.S. Pat. No. 4,800,036 (Rose et al), and U.S. Pat. No. 4,337,163 (Schilp). The thickened liquids usually are disclosed for use as detergents in dish washers, sink drains and laundry washers, and some are also suggested for removing mildew.

Additives for stabilizing aqueous hypochlorite solutions against decomposition caused by temperature and other aging effects during storage are known. For example, U.S. Pat. No. 4,071,463 (Steinhauer) discloses for use as an alkali metal hypochlorite stabilizer, certain synthetic detergents (e.g., alkali metal alkyl sulfates and alkyl aryl sulfonates) and U.S. Pat. No. 4,898,681 (Burton), discloses calcium chelate of disodium ethylenediaminetetraacetic acid for such stabilizing use.

Although the known aqueous alkali metal hypochlorite cleaning compositions are useful for removing some mildew stains from surfaces, improvements are desired to greatly increase the cleaning efficiency of mildew stain removal so that scrubbing and/or high-pressure water-hosing normally is not required after the cleaning composition is used on a stained surface.

SUMMARY OF THE INVENTION

The present invention provides a cleaning composition for removing stubborn mildew from a surface normally without scrubbing. The cleaning composition is of the type that comprises an aqueous solution of an alkali metal hypochlorite, an alkaline builder that maintains the solution at a pH of at least 11, and a hypochlorite-compatible surfactant. The cleaning composition is a fluid foam that has, in combination, as measured by methods described hereinafter, (a) a precursor-solution relative viscosity of no greater than three, preferably in the range of 0.8 to 1.5, (b) a syneresis value in the range of 2 to 40%, preferably in the range of 10 to 30%, (c) a foam horizontal thickness half-life of at least 12 minutes, preferably at least 15 minutes, and (d) a vertical-surface clingability of at least 7 minutes, preferably at least 10 minutes. A preferred alkali metal hypochlorite is sodium hypochlorite which is present in a concentration in the range of 1 to 15 percent, preferably 3 to 10%, by total weight of the aqueous cleaning composition. A preferred alkaline builder is sodium hydroxide or potassium hydroxide. Preferably, the aqueous solution of alkali metal hypochlorite is free of undesired metal ions. Preferred compatible surfactants are a cocamine oxide, a sodium alkyl alkanoate and sodium dodecyl diphenyl disulfonate, present in a concentration range of 0.1 to 10%.

The invention also provides a method for forming the above-described cleaning composition fluid foam. The method comprises (a) preparing an aqueous solution of an alkali metal hypochlorite, preferably purified of unwanted metal ions, an alkaline builder that maintains the solution at a pH of at least 11, and a hypochlorite-compatible surfactant in a container and (b) vigorously agitating the solution in the presence of a gas with mechanical stirrers or by fluidic/pneumatic action of a fluid jet, preferably produced by a mechanical breakup actuator of an aerosol dispenser in the presence of propellant. Preferably, the foam is produced with a low-boiling hydrocarbon propellant in an aerosol dispenser made of materials compatible with the aqueous solution. Preferred propellants include propane, butane, isobutane and mixtures thereof in a concentration of 1 to 15%, preferably 3 to 10%, by weight of the aqueous cleaning composition. In the preferred aerosol dispenser, all parts and surfaces that contact the aqueous cleaning composition are of hypochlorite-compatible metal, rubber or plastic. Preferred plastic materials are polyethylene, polypropylene, nylon and polyester.

BRIEF DESCRIPTION OF THE DRAWINGS

The invention will be more readily understood by reference to the accompanying drawings, in which.

DETAILED DESCRIPTION OF PREFERRED EMBODIMENTS

Figure 1:
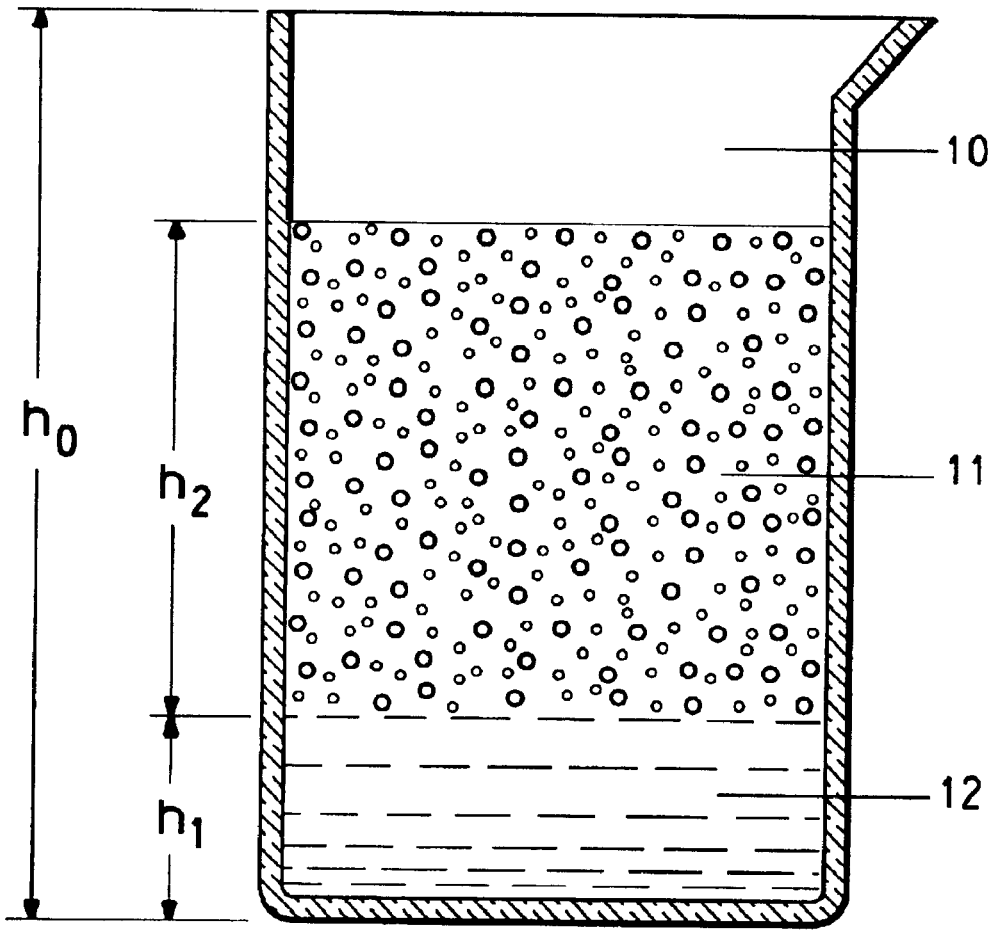
FIG. 1 is a side view of a graduated glass cylinder 10 in which the heights of foam 11 and separated liquid 12 are measured during a "syneresis value" test and wherein $h_0$ is the original height of the foam in the filled cylinder at the start of the test, and $h_1$ and $h_2$ are respectively the thickness of the separated liquid layer and the thickness of the foam layer at a given time during the test.

The following detailed description of preferred embodiments of the invention is included for purposes of illustration and is not intended to limit the scope of the invention. The scope is defined by the claims appended below.

Definitions

For convenience and clarity, the meaning will now be given of several terms and characteristics that are used to describe the invention. Descriptions of tests employed to quantitatively measure some of the characteristics follow the list of definitions.

"Mildew" refers to any one or combination of mycological stains including household mildew, algae, fungus, spores etc.

"Stubborn mildew stain" refers to gray or black mildew which grew on a surface over a long period of time during which the mildew color typically changed from yellow to pink to green and finally to gray and black.

"Alkaline builder", also referred to in the art as an "override substance", is a chemical buffer that maintains an aqueous alkali metal hypochlorite solution at a pH of at least 11, and helps prevent decomposition of the solution, thereby increasing the shelf life of the solution.

"Compatible" means that a particular material or substance being referred to does not substantially adversely affect cleaning efficiency of a fluid foam of the invention or the performance of its dispenser device.

"Clingability" refers to the ability of a foam to cling or adhere to a vertical surface, measured as described herein below.

"Osterizer" refers to an electric mixer, usually used in food preparation, but employed herein to prepare fluid foams of various compositions, as reported in the Examples.

"Pouched dispenser" or "barrier dispenser" refers to a pressurized dispenser in which the aqueous hypochlorite solution is contained inside a pouch made of materials compatible with the solution, the pouch itself being suspended from and sealed to the dispenser valve and not in intimate contact with the inner walls of the dispenser.

"Stabilized hypochlorite" or "purified hypochlorite" refers to alkali metal hypochlorite solution from which detrimental impurities, including meal ions such as aluminum, copper and iron, were removed by filtration or by chelation or by other techniques.

"Cleanability" refers to a numerical ranking of the degree of whiteness or color shade change that occurs as a result of the application of a cleaning composition to a stained panel, measured as described herein below.

"Precursor solution" refers to the cleaning composition of aqueous solution of alkali metal hypochlorite, alkaline builder, surfactant and optional additives, prior to conversion of the cleaning composition into a fluid foam.

"Syneresis value" is a measure of the amount of liquid that separates from a fluid foam, measured as described herein below.

"Horizontal thickness half life" is the time interval required for an aqueous foam to lose 50% of its thickness, as measured in the syneresis value test.

"Actuator with mechanical breakup" refers to a known actuator which incorporates a feature to reduce spray particle size (e.g., a circular or near circular swirl chamber, or a channel with several tangential entries).

Test Procedures

Cleanability. The cleaning effectiveness of different products is tested on a landscaping timber that has stubborn mildew stains distributed over its surface. The stained landscaping timber typically measures 240 cm. (8 feet) in length and about 7.2 cm. (3-in) by 10.2 cm. (4 inch) in rectangular cross section with rounded edges. Landscaping timbers of this type frequently are found in yard or garden areas around residential homes. When exposed to the environment of a humid climate for a long time (e.g., a few years), the timbers become covered with a layer of a high intensity grey or black, stubborn mycological stains. Such stained timbers are ideal for running a large number of tests to evaluate and compare, side by side, the effectiveness of different mildew removers. In preparation for a series of cleanability tests, a landscaping timber is placed horizontally on the ground with the longer side of its cross section perpendicular to the ground. The timber is then marked with vertical lines to divide the timber into test panels of about 5-cm width. The panels are numbered for identification. Every other panel is used as a test panel on which a sample of the cleaning composition being tested is placed for a predetermined period of time. At the end of the time period, the test panel is rinsed with water. The non-treated stained alternate panels on each side of the test panel serve as controls.

At the completion of the tests and the rinsing with water, the test panels are allowed to dry without scrubbing. Then, the cleanliness of each test panel is measured relative to its adjacent controls by a method known as "Gray Scale for Evaluating Changes in Color", referred to as ISO International Standard R105/1, Part 2. According to this method, the difference between the color of the test item and its adjacent controls is matched with the closest contrast between gray color pairs printed on a standard template. The scale on the gray scale template extends from 1 for the largest difference in color contrast to 5 for no visible contrast difference, with fractions in between making a total of 10 gray scale panel pairs. By use of standard tables published with the Gray Scale method, the numbers obtained from the gray scale comparison are converted to "Total Color Difference" expressed in "CIE Lab Units". The total Color Differences range from zero CIE Lab Units for a gray scale rating of 5 to 13.7 CIE Lab Units (reported herein for simplicity as 14) for a gray scale rating of 1. In the examples below, all cleanability ratings are reported in CIE Lab Units.

Relative Viscosity. The relative viscosity of an aqueous precursor solution (i.e., the aqueous solution of alkali metal hypochlorite, alkaline builder, surfactant and optional additives, prior to conversion into a fluid foam cleaner) is measured herein by a simple laboratory apparatus having a vertical arrangement of a right conical plastic funnel with an outlet tube attached and sealed to a plastic capillary tube. The internal diameter of the circular upper end of the funnel is 5.1 cm. The diameter of the circular lower end of the funnel is 0.64 cm. The distance between the upper and lower ends of the conical portion of the funnel is of 4.5 cm. An exit stem extends 2.5 cm from the lower end of the funnel. A 17.8-cm long capillary tube of 0.1-cm internal diameter is inserted 2.0 cm into the end of the funnel stem and sealed thereto. The total capacity of the apparatus from the upper end of the funnel to the outlet end of the capillary tube is 35 $cm^3$. All flows through the apparatus are measured at 21° C. To determine the relative viscosity of an aqueous liquid, (a) the apparatus is first completely filled with the liquid, (b) the time required for the liquid to flow through the apparatus is measured and (c) the time required for the same volume water to flow through the apparatus is measured. The relative viscosity, RV, of the aqueous liquid is defined as the ratio of $t_{test}$ to $t_{water}$, where $t_{test}$ is the measured time for the test liquid to flow through the apparatus and $t_{water}$ is the measured time for water to flow through the apparatus. Relative viscosities at different shear rates are obtained by repeating the procedure with capillaries of different dimensions. The relative viscosities reported herein were measured on precursor solution at a shear rate of 7 $sec^{-1}$.

Syneresis Value and Foam Horizontal Thickness Half-life. The syneresis value and the horizontal thickness half-life of a fluid foam are measured with a graduated plastic or glass cylinder, as depicted in FIG. 1. The cylinder is initially filled completely to its full internal height $h_0$ with a clearing composition foam and the cylinder is placed upright on a horizontal surface. The thickness $h_2$ of foam layer 11 and the thickness $h_1$ of separated liquid layer 12 are measured as functions of time during the test. The "syneresis value", SV of the fluid foam, is expressed as a percentage of the initial thickness of the foam and is calculated by the formula, $SV=100(h_1/h_0)$. Because the syneresis value rarely changes after 45 minutes of testing, the syneresis values reported herein were based on measurements made at about 45 minutes. A graph is prepared of the thickness $h_2$ of the foam, expressed as a % of the initial foam thickness $h_0$, versus time and the horizontal thickness half-life of a cleaning composition fluid foam is determined as the time (measured from the start of the test) at which $100(h_2/h_0)$ equals 50%.

Vertical Surface Clingability. "The ability of a fluid foam or other aqueous cleaning composition to cling to a vertical surface is measured as follows. A test fluid foam or aqueous liquid cleaner is sprayed onto or otherwise applied in sufficient quantity to substantially cover a vertical 7.2-cm. by 10.2 cm. test panel on one side of a landscaping timber (of the type described above in the "cleanability" test). With increasing time after cleaner application, the area covered by the test cleaning composition shrinks. A graph is constructed of the % of the area covered by the shrinking test material as a function of time after application. The vertical clingability reported herein is defined as the time required for the area of the applied test material to shrink to 50% of its initial area coverage.

Fluid Foams

According to the present invention, a typical cleaning composition is a fluid foam that contains (a) an aqueous solution of an alkali metal hypochlorite, preferably sodium hypochlorite or potassium hypochlorite in a concentration range of 1% to 15% by total weight of the solution; (b) an alkaline builder, preferably sodium hydroxide or potassium hydroxide in a concentration range of 0.01% to 1.0% in excess of amount needed to maintain the aqueous solution at a pH of at least 11, (c) a hypochlorite compatible surfactant, in a concentration range of 0.1 to 10%, such as a cocamine oxide, and (d) other optional enhancing agents, such a compatible fragrance, a soap-scum remover, such as tri-sodium phosphate, in a concentration range of 1% to 10%, and a hypochlorite stabilizer, such as a chelating agent in a concentration range of 0.005% to 0.25%. The cleaning composition fluid foam of the invention has a combination of characteristics that provides greatly improved mildew-removing efficiency to the cleaner. The characteristics of the cleaning composition foam are (a) a relative viscosity of the aqueous precursor solution of no greater than 3, preferably 0.8 to 1.5, (b) a foam syneresis value in the range of 2 to 40%, preferably 10 to 30%, (c) a foam horizontal thickness half life of at least 12 minutes, preferably at least 15 minutes, and (d) a foam vertical-surface clingability of at least 7 minutes, preferably at least 10 minutes. Because of this combination of characteristics, the cleaning composition fluid foam of the invention brings into contact with a stained surface substantially larger amounts of stain-removing alkali metal hypochlorite for longer times than is provided by known aqueous cleaning compositions of equal hypochlorite concentration applied to a stained surface in the form of a sprayed liquid, a short-lived foam, a thickened liquid or a gel. The superior cleaning efficiency of the fluid foams of the invention compared to known cleaners of similar composition is believed to be a result of the liquid-rich cells of the fluid foam of the invention clinging strongly to the surface being cleaned and the cells breaking up slowly so that a continuous source of the alkali metal hypochlorite is efficiently delivered to the stained surface. Thus, a fluid foam of the invention has a longer contact time with the stained surface and provides a greater amount stain-removing agents to react with the stain.

As shown in the Examples below, the present inventor found that the fluid foams of the invention provide better cleaning without scrubbing than any of the known hypochlorite-containing cleaners he tested. Substantially the same superior cleaning results, as were obtained in the cleaning of the mildew covered surfaces of the landscaping timbers, are obtained when the fluid foam cleaning compositions of the invention are applied to stained surfaces of painted wood, plastic film, cement, plaster, fabric or the like. In addition, the cleaning composition fluid foam of the invention, even without the inclusion of a fragrance, was found to mask to a substantial degree, the smell of the alkali metal hypochlorite. Also, during application of the fluid foam cleaning composition of the invention to a stained surface, the typically opaque white color of the fluid foam provided an easily seen indicator of whether the cleaner had missed any particular area of the surface. The present inventor further found that fluid foam cleaner of the invention also removed soap scum, dirt and oily stains.

Fluid foams having characteristics outside the combination of characteristics set forth above for the fluid foam of this invention are deficient in their ability to remove stubborn mycological and mildew stains without brushing or scrubbing. For example, a thick liquid having high relative viscosity is not readily formed into a fluid foam cleaning composition of the invention and is not readily removable from a surface by rinsing. Typically, when such a thick liquid is used to clean a surface, scrubbing is required to remove a layer of the cleaner that remains on the surface even after rinsing. A fluid foam having very low syneresis value does not clean well because it does not carry and release an adequate amount of the active cleaning agent to the stained surface, even if the vertical clingability of the foam is high. Also, a foam that has an excessively large syneresis value often is too thin and slippery, which prevents the foam from adhering to the stained surface long enough to accomplish the cleaning. A foam having very short horizontal thickness half-life or a very low vertical surface clingability also leaves the stained surface too quickly to allow for adequate cleaning.

Producing and Dispensing Fluid Foam

The process for producing a cleaning composition fluid foam of the invention typically comprises two-steps. First an aqueous solution is prepared containing an alkali metal hypochlorite, an alkaline builder that maintains the solution at a pH of at least 11, and a hypochlorite-compatible surfactant, each in the desired concentrations recited herein before. Then the solution is vigorously agitated in the presence of a gas. The vigorous agitation can be achieved with mechanical stirrers, but preferably is provided by the fluidic/pneumatic action of a fluid jet, such as is produced by a mechanical breakup actuator of an aerosol dispenser in the presence of propellant. Preferably, the foam is produced with a low-boiling hydrocarbon propellant in an aerosol dispenser made of materials compatible with the aqueous solution. Preferred propellants include propane, n-butane, isobutane and mixtures thereof in a concentration of 1 to 15% by the weight of the aqueous solution. Parts and surfaces of the aerosol dispenser that contact the aqueous solution are of hypochlorite-compatible metal, rubber or plastic.

The preferred method of preparing and dispensing a fluid foam of the invention will now be described with particular reference to the aerosol dispenser depicted in FIG. 2. An aqueous solution of alkali metal hypochlorite, alkaline builder and surfactant, in accordance with the concentrations required for the fluid foam cleaner of the present invention, is mixed and placed in the container of the aerosol dispenser. The outer wall of the dispenser container typically is of a metal, plastic or glass of sufficient strength to withstand the internal pressures expected during use. The container has an inner liner made of hypochlorite-compatible glass or plastic. Polyethylene and polypropylene are preferred liner materials. A container particularly suited for use with the aqueous solutions is commercially available from ALCAON PACKAGING of ALgroup Wheaton of Netherlands.

Figure 2:
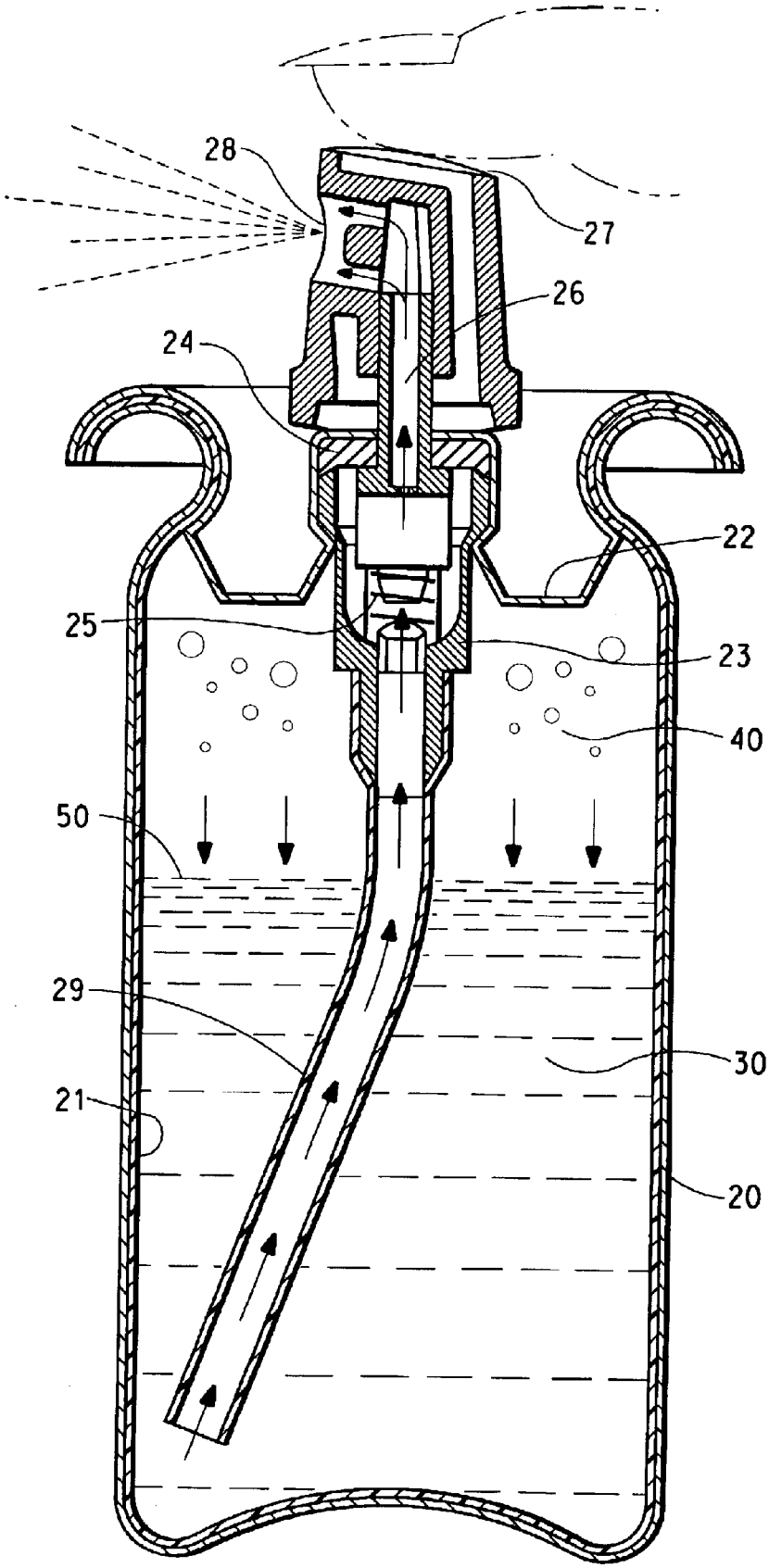
FIG. 2 is a schematic representation of an aerosol dispenser suitable for dispensing an aqueous foam of the invention, wherein 20 is a cylindrical container, 21 is a hypochlorite-compatible inner liner of the container, 22 is a similarly lined cover in which is mounted a valve assembly comprising housing 23, gasket 24, spring 25, hollow valve stem 26, button actuator 27, exit nozzle 28, and dip tube 29, and wherein 30 is a mixture of aqueous hypochlorite solution and propellant liquid, 40 is a space filled with propellant vapor, and 50 is a layer of liquid propellant, normally present before the dispenser is shaken prior to use.

The aerosol dispenser, as depicted in FIG. 2, comprises a cylindrical container 20 having a cover (also called a "mounting cup") 22 attached to the top of the container. The container has an inner liner insert 21 of hypochlorite compatible material. Cover 22 has a hypochlorite-compatible material laminated to its inner surface. Valve components of the aerosol dispenser are pre-assembled to form a valve assembly unit, which includes housing 23, valve stem gasket 24, spring 25, valve stem 26, actuator button 27 containing nozzle 28, and dip tube 29. The valve assembly unit is inserted through an opening in the center of cover 22 and is attached to the cover to form a valve/cover assembly. An aqueous precursor solution is prepared, mixed and loaded into container 20. Then, the pre-assembled valve/cover assembly is installed in the container. The hypochlorite-compatible material laminated to the circumferential edge of cover 22 is brought into contact with the upper rim of hypochlorite-compatible inner liner 21 of container 20 and then the circumferential edge of cover 22 and the top edge of container 20 are mechanically crimped together, so that the hypochlorite-comopatible materials of the cover laminate and the container inner liner form a seal. Optionally, a cover-sealing gasket, not shown in FIG. 2, can be installed. All parts of the aerosol dispenser are made of materials compatible with aqueous hypochlorite solution. A suitable design of spray valve assembly for installation in the cover of the aerosol dispenser is commercially available from Precision Valve Corporation, Yonkers, N.Y. or from Seaquist Perfect Dispensing of Gary, Ind. In such spray valve assemblies, the housing and valve stem can be made of nylon, the dip tube and actuator button of polyethylene or polypropylene, the valve stem gasket of butyl rubber U-133, of an ethylene/propylene copolymer or of Viton® synthetic rubber (from Dupont Dow Elastomers LLC of Wilmington, Del.) and the coil spring of passivated stainless steel, tantalum or titanium. Typically, the cylindrical container and cover can be made of aluminum, steel or tin plate, the cover being laminated with a film of polyethylene or polypropylene on its inner surfaces and the cylinder having an inner liner insert of polyethylene or polypropylene.

After the dispenser container is loaded with solution and the cover and spray valve assembly installed and sealed, propellant (usually as liquid) is injected under pressure through the valve assembly into the container where part mixes with aqueous solution 30, part floats as a liquid layer 50, atop the solution, and part forms a gaseous phase that fills pace 40, thereby providing the pressure needed to drive the solution/propellant mix through the valve assembly when the valve is opened. Preferred propellants include propane, butane, isobutane and mixtures thereof in quantities amounting to 1 to 15% of the weight of the aqueous solution. Before opening the valve, the dispenser is shaken to mix the propellant with the aqueous liquid in the container. Then, depressing actuator button 27 against spring 25 causes gasket 24 to flex and expose the orifices in the wall of valve stem 26 to pressure, which allows the mix of cleaning composition solution and liquid propellant to flow through valve stem 26, through the passages of button actuator 27 and through nozzle 28. Nozzle 28 has a mechanical break-up actuator insert located just upstream of the nozzle exit. Typically, the mixture emerging from the actuator nozzle is like a mist that when dispensed onto a surface, converts almost immediately to fluid foam of the invention.

Within the actuators of the aerosol dispensers, certain design features can improve sprayed foam formation. Such features include, upstream of the exit nozzle, mechanical breakup mechanisms to reduce spray particle size. Typical break-up mechanisms include a circular or near circular swirl chamber, one or more tangential entries to a chamber, orifices, screens, and/or special exit nozzles. The aerosol dispenser can also include an extension tube, not shown in FIG. 2, which extends from the exit of button 27 and has a mechanical break-up orifice located at the exit end of the extension tube.

EXAMPLES

The following examples illustrate the preparation of cleaning composition fluid foams of the invention and demonstrate the unexpectedly large advantage in mildew removal that these fluid foams possess over known hypochlorite-containing cleaners, as well as other hypochlorite-containing cleaners that are outside the invention. The reported results are believed to be fully representative of the invention, but do not constitute all the tests involving the indicated cleaning compositions. In the examples, all concentrations of ingredients, unless specifically stated otherwise, are by % of the total weight of aqueous solution.

In the Examples, fluid foam of the invention was produced by vigorously agitating aqueous alkali metal hypochlorite solution, while in contact with a gas, such as air, or a low boiling liquid hydrocarbon propellant. Vigorous agitation was produced by mechanical or fluidic/pneumatic means. Test foams of the invention prepared by vigorous mechanical agitation of liquid solution in the presence of air were produced in an 800-watt AC "Osterizer" manufactured by Oster Corporation of Miluakee, Wis., having a 1.2-liter-capacity glass container. The foam produced by the Osterizer was dispensed to a test panel surface by pouring, by brushing or with a spatula. When vigorous agitation was provided by an aerosol dispenser, a dispenser of the general type illustrated in FIG. 2 was employed. When a commercial hypochlorite-containing cleaning composition was tested, the commercial product was employed in accordance with its manufacturer's instructions and usually applied to the test panel with the manufacturer-supplied plastic hand pumped spray nozzle.

The Examples, especially Examples 2 and 3, demonstrate that hand pumped dispensers of the type common in the art, do not provide sufficiently intense mechanical agitation to produce a fluid foam of the invention and as a result do not provide the improved cleaning efficiency of the fluid foams of the invention.

Example 1

This example quantitatively demonstrates the greater mildew-removing effectiveness of aqueous hypochlorite-containing cleaning compositions applied as fluid foams of the invention over the same hypochlorite-containing compositions applied as liquids. Side by side comparisons were made of the cleaning effectiveness on the same mildew stained landscaping timber.

Five different aqueous solutions were prepared. The solutions had sodium hypochlorite concentrations of 1, 2, 3, 4 and 5%. Each solution also contained a 0.5% concentration sodium hydroxide alkaline builder to maintain the aqueous solution at a pH of at least 11 and a 1.5% concentration of non-ionic surfactant "Barlox 12" cocamine oxide (available from Lonza Speciality Chemical Company of N.J.). The surfactant has an average molecular weight of 249 and is a mixture of N,N-dimethyl-1-dodecylamine-N-oxide, N,N-dimethyl-1-tetradecyl-amine-N-oxide, and N,N-dimethyl-1-hexadecylamine-N-oxide. A 200-$cm^3$ portion of each liquid solution was converted to a fluid foam of the invention by vigorous mechanical agitation of the solution in an Osterizer set at a high (i.e., "whip" setting) for 20 seconds. Then each liquid solution and its corresponding same composition fluid foam were applied to side-by-side cleanability test panels of a landscaping timber stained with stubborn mildew. The total color difference produced on each test panel by the liquid or foam was measured five minutes after application of the liquid or foam to the panel. Test results are summarized in the following table.

TABLE I

Cleanability of liquid vs. fluid foam hypochiorite-containing cleaners

| | NaOCl | Cleanability (total color difference) | | |
|---|---|---|---|---|
| Sample | % Conc. | Foam | Liquid | Foam advantage |
| 1 | 1.0 | 4.1 | 3.4 | 20% |
| 2 | 2.0 | 4.8 | 3.4 | 41% |
| 3 | 3.0 | 6.8 | 4.1 | 66% |
| 4 | 4.0 | 9.6 | 4.1 | 134% |
| 5 | 5.0 | 14 | 4.1 | 241% |

The above-summarized cleanability measurements show that fluid foams of the invention have a large mildew stain-removing advantage over corresponding comparison liquids having the same chemical composition. In the table, the advantage is expressed as a % difference between the cleanability rating of the foam versus that of the corresponding liquid. The results also demonstrate the larger advantage of preferred hypochlorite concentrations of at least 3%. Note particularly the 241% advantage of nearly 10 gray scale color difference units for the 5% hypochlorite concentration in the fluid foam cleaner of the invention over the corresponding liquid cleaner.

Example 2

In this example, a series of five-minute cleanability tests were performed with commercially available aqueous hypochlorite-containing cleaners. Test panels on the same mildew-stained landscaping timber as used in Example 1 were treated in this example in order to compare the commercial cleaners to cleaning composition fluid foams of the invention. The commercial cleaners are designated with lower case letters.

TABLE II

Cleanabilty rating of commercial aqueous hypochlorite cleaners

| Commercial Product Description | Spray applied as | Cleanability Rating |
|---|---|---|
| a. Dow soap scum plus mildew stain remover (3% NaOCl) | a thin foam | 2.5 |
| b. Clorox Tilex instant mildew remover (1.65% NaOCl) | a liquid | 0 |
| c. Clorox cleanup gel* | a gel | 0 |
| d. Meriplus Tile plus instant mildew stain remover* | a liquid | 4.0 |
| e. Beneckiser Scrub free mildew remover* | a liquid | 0 |
| f. Clorox liquid bleach (5.25% NaOCl) | a liquid | 4.0 |

*the asterisk means that the product contained an unspecified concentration of hypochlorite Note that none of the above-listed commercial products cleaned the stained timbers nearly as well as the foam cleaner of the invention. Clorox liquid bleach, the product designated "f" in the table, with a 5.25% NaOCl concentration was the best performing commercial product, but its cleanability rating was only 4.0, in contrast to a rating of 14.0 for a foam of the invention having an NaOCl concentration of 5% (see Table I).

Another series of cleanability rating tests, performed with different (from the above-listed) commercially available hypochlorite-containing aqueous cleaners, showed that no product even matched the cleanability rating of the Clorox liquid having a 5.25% NaOCl content, which still was much inferior in cleanability rating to the foams of the invention. Thus, these tests again showed the great superiority in cleaning effectiveness of the cleaning composition fluid foams of the invention over currently available commercial products. In these two series of cleanability tests, more than a dozen commercially available hypochlorite-containing cleaners were tested. It was further noted that each of the commercial cleaning products had a vertical clingability and a horizontal half-life that were very much smaller than those of the fluid foams of the invention of Example 1.

Example 3

In this example, the cleanability rating of two cleaning composition fluid foams of the invention were compared with an aqueous sodium hypochlorite composition that was thickened with a visco-elastic surfactant.

A thickened aqueous composition, which was substantially the same as the composition disclosed in Example 2 of U.S. Pat. No. 4,800,036 (Rose), was prepared as follows. To 544.2 grams of a 5.25% active NaOCl aqueous bleach (sold by Clorox Corporation), 441.5 grams of distilled water were added. Then, 7.14 grams of hexadecyltrimethlammonium bromide and 7.14 grams of sodium p-toluene sulfonate were added to the aqueous bleach. The last two solid ingredients were dissolved in the liquid by stirring with a spatula for about 30 minutes. The resulting solution, which was transferred to a plastic bottle, had calculated concentrations of 2.86% NaOCl; 0.71% hexadecyltrimethylammonium bromide, 0.71% sodium p-toluene sulfonate and 95.72% water. The solution was yellowish, very thick (viscous) compared to water and tended to form clumps or streaks of even thicker liquid dispersed in the solution when the container was shaken. Cleanability tests were performed by applying this aqueous formulation to the test panels in three different ways, namely (1) as liquid solution poured onto the test panel, (2) as a spray, dispensed from the same hand-pumped spray foaming device as was used for commercial sample "a" of Example 2, and (3) as a foam prepared by whipping a 200-$cm_3$ portion of the solution for 30 seconds in the Osterizer immediately before being applied to a test panel. These three test samples were designated T1, T2 and T3. Note that a thickened foam such as T3, which was prepared in the Osterizer, is not disclosed or suggested in U.S. Pat. No. 4,800,036.

The aqueous cleaning composition fluid foams of the invention with which the above-described thickened formulations were compared were designated as Samples 6 and 7. The samples contained 0.5 and 0.3% NaOH alkaline builder respectively and 1.5% Barlox cocamine oxide surfactant. NaOCl concentrations in Samples 6 and 7 were 5.0 and 3.0% respectively. Precursor solutions of Samples 6 and 7 had relative viscosities in the range of 1.1 to 1.5. Samples 6 and 7 were then vigorously agitated in the Osterizer to produce fluid foam of the invention. The fluid foams of Samples 6 and 7 had vertical surface clingabilities in the range of 7 to 12 minutes and horizontal half-lifes of greater than 15. In contrast to the fluid foams of the invention, each of the thickened samples had a precursor solution of vastly higher relative viscosity (e.g., at least 500% the viscosity of water) and a very short vertical clingability of less than 20 seconds:

The cleanability ratings in 10-minute tests of the three thickened samples, T1, T2 and T3, and the fluid foams of the invention, Samples 6 and 7 were measured, side by side, on the same stained landscaping timber. The results of the measurements are summarized below in Table III.

TABLE III

Cleanability rating of thickened cleaners vs. foams of invention

| | | % NaOCl | Cleanability Rating |
|---|---|---|---|
| Of invention: | Sample 6 | 5.0 | 14 |
| | Sample 7 | 3.0 | 9.6 |
| Thickened: | Liquid T1 | 2.86 | 4.8 |
| | Spray T2 | 2.86 | 4.8 |
| | Osterizer foam t3 | 2.86 | 6.8 |

Table III shows that the applications of the thickened liquid and spray (T1 and T2 respectively) performed poorly in the cleanability tests compared to the fluid foams of the invention. Even when the thickened formulation was vigorously agitated in the Osterizer to form a foam, the cleanability ratings of the thickened foam was much inferior to the foams of the invention. It was also noted that the thickened liquid and spray samples had a consistency resembling that of an uncooked beaten egg and had a tendency to run down and slip off the vertical panels. Further, after the tests panels were rinsed with water, some amounts of sticky film remained on the panels and could not be rinsed away without scrubbing or brushing. By contrast the surfaces treated with the foam of this invention were completely cleaned by simple rinsing with room temperature water with no residues left behind.

Example 4

This example illustrates the use of an aerosol dispenser of the general design depicted in FIG. 2 to produce fluid foam cleaning composition of the invention. An aqueous solution was prepared to contain 5% sodium hypochlorite, 0.5% sodium hydroxide alkaline builder, and 1.5% Barlox-12 surfactant which contains 30% cocamine oxide in water. A 320-$cm^3$ volume of the aqueous solution was loaded into each of several aerosol dispenser containers. Each dispense measured 15 cm high by 6.3 cm in diameter. The internal surfaces of the containers were epoxy-coated. The dispensers were equipped with valves and actuators of the mechanical break-up type having an orifice diameter of 0.045 cm (0.018 inch). One of three different hydrocarbon propellant mixtures was loaded into each container; namely; (1) AERON® NP-31 consisting of 81.3% n-butane, 16.6% propane and 2.1% isobutane, and having a nominal vapor pressure of 225 KPa (33 psig;), (2) AERON® NP-46 consisting of 68.5% n-butane, 31.5% propane, and having a nominal vapor pressure of 317 KPa (46 psig); and (3) AERON® NP-70 consisting of 42.5% n-butane and 57.5% propane and having a vapor pressure of 483 KPa (70 psig). The AERON® propellants were obtained from Diversified Propellant Company International, Inc., USA. All percentages for the propellant compositions are in mole %. The containers were loaded to provide propellant concentrations of 5, 3, 2 and 1.25% by total weight of the aqueous solution. The foam properties and cleanability ratings of the aerosol-dispenser-produced fluid foams were then measured. The measurements showed the following:

(a.) At propellant concentrations of 5%, the dispensed foam was very thick and had relatively low levels of syneresis in the range of 2 to 3%. Adequate, but relatively low, cleanability ratings in the range of 5 to 8 were obtained in the 10-minute cleanability tests.

(b.) At lower propellant concentrations in the range of 1.25 to 3%, good foams of the invention were obtained. Each foams had a syneresis value in the range of 13 to 25%; a vertical wall clingability in the range of 11 to 20 minutes; a horizontal foam thickness half-life of greater than 60 minutes and a 10-minute cleanability ratings in the range of 12 to 14.

(c.) Although the aqueous hypochlorite-containing solutions used in these aerosol dispensers initially provided highly satisfactory foams and corresponding cleanability ratings, because of the materials of construction of the aerosol dispenser containers, within three days after filling the containers, leaks developed in the dispensers.

Further tests, in which similar aerosol cans were constructed with liners, gaskets, dip tubes and other parts of different materials, resulted in identifying preferred materials for all the parts of the aerosol dispensers. The preferred materials, as set forth above in the detailed description of the invention, were compatible with the aqueous hypochlorite solutions and thereby permitted the solutions to be stored in the dispenser for long periods of time.

Example 5

This example illustrates the use of a pouched or barrier dispenser as an aerosol dispenser system for producing fluid foam of this invention. In this dispenser system, an aqueous hypochlorite solution and propellant are injected inside a flexible pouch suspended from the valve inside the dispenser container and the space between the pouch and the wall of the container is filled with nitrogen or air. Two pouches of different material were tested. In each test, the pouch was attached to an aerosol valve assembly similar to the type depicted in the dispenser of FIG. 2.

In the first test, the pouch was made of a plastic film that was lined with a layer of nylon polymer. The pouch was filled with the same composition aqueous hypochlorite solution as was used in Example 4. The solution contained 5% sodium hypochlorite, 0.5% sodium hydroxide alkaline builder, and 1.5% Barlox-12 surfactant. Pressurized air filled the space between the pouch and the inner wall of the container. This pouched dispenser system initially produced good quality foam having satisfactory cleanability ratings, but after several days of storage, the system developed leaks.

In the second test, the pouch was constructed from two layers of plastic film between which was a layer of aluminum foil. This pouch had a capacity of 215 $cm^3$. The internal volume of the container was 329 $cm^3$. The pouch was filled with 202 grams of solution of the same composition as was used in the test described in the preceding paragraph. The space between the pouch and the walls of the dispenser container was filled with nitrogen at a pressure of 172 KPa absolute (25 psia). A charge of 6 grams of pressurized propellant AERON® NP-46 (consisting of 68.5 mole % n-butane and 31.5 mole % propane) was injected into the solution to provide a propellant concentration of 2.96% in the solution. After the contents of the container were shaken to assure full mixing, the solution was dispensed through the actuator to the surface of a mildew stained landscaping timber for cleanability rating. A fluid foam cleaner of the invention was obtained. The 10-minute cleanability rating was 14 on the $7^{th}$ and $8^{th}$ days after the dispenser had been filled. The rating was 9.6 on the $47^{th}$ and $81^{st}$ day after filling. At 47 days after filling, the syneresis value was 24% and the vertical area clingability was 14 minutes.

Example 6

In this example, evaluations were made of the effectiveness of different methods of stabilizing aqueous hypochlorite solutions against decomposition during storage, as measured by changes in the cleanability values of fluid foams of the invention. Earlier tests and the preceding examples illustrated the need to employ dispensers constructed of hypochlorite-compatible materials and to use hypochlorite-compatible surfactants in the solution. It was also known that hypochlorite decomposition can be reduced by using an alkaline builder to maintain the solutions at a pH of least 11. In this example, the effects of the initial hypochlorite purity and the use of a chelating agent were investigated.

A first series of tests employed three commercial grades of different purity aqueous sodium hypochlorite. These three grades of sodium hypochlorite were obtained from Olin Chlor Alkali Products, a Division of Olin Corporation and were designated (1) HyPure®, of the highest purity, (2) NF, of intermediate purity and (3) industrial grade, of the lowest purity. A second group of solutions was made with the industrial grade aqueous hypochlorites, but with the addition of Versene® Ca chelating agent (a calcium chelate of the disodium salt of ethylenediamine-tetraacetid acid dihydrate (sold by Dow Chemical Company) to the hypochlorite prior to storage. The chelating agent was reported to act as a purifying or stabilizing agent for aqueous hypochlorite. Samples of each of these hypochlorites were stored for 45 and 176 days and then used to make the test solutions. Each test aqueous solution was formulated to contain a 5% concentration of NaOCl, sufficient NaOH to maintain the solution at an initial pH of at least 11, and a 1.5% concentration of Barlox-12 surfactant. The test solutions were then converted by Osterizer agitation to fluid foam cleaners which were then subjected to the cleanability rating test. The 10-minute cleanability ratings of the foams are recorded in the following table.

TABLE IV

Stability of foam cleaners

| NaOCl Grade | Versene Concentration | age (days) | pH | Cleanability Rating |
|---|---|---|---|---|
| 1. HyPure ® | 0% | 45 | 12 | 14 |
| | 0% | 176 | 13 | 11.5 |
| 2. Intermediate | 0% | 45 | 10 | 14 |
| | 0% | 176 | 7 | 2.4 |
| 3. Industrial | 0% | 45 | 11 | 14 |
| | 0% | 176 | 7 | 3.5 |
| | 0.015% | 176 | 13 | 14 |
| | 0.15% | 176 | 7 | 0 |
| | 1.0% | 176 | 8 | 0 |

The above-summarized data show that the fluid foams of the invention made with aqueous hypochlorite of the highest purity have very good cleanability ratings and satisfactory storage life. The data also show that the use of small concentrations of chelating agent can significantly improve the storage life and cleanability rating of fluid foams made with industrial grade aqueous hypochlorite. However, increasing the chelating agent concentration from 0.015% to 0.15% and 1.0% apparently causes the pH of the industrial grade hypochlorite solution to decrease significantly below the pH of at least 11 that is needed for preventing hypochlorite decomposition.

Additional tests showed that fragrance additives can sometimes detrimentally affect the hypochlorite stability. However, in low concentrations such additives can be used satisfactorily.

Many different embodiments of this invention may be made without departing from the spirit and scope of the invention. Therefore, the scope of the invention is not intended to be limited except as indicated in the appended claims.

I claim:

1. A cleaning composition comprising an aqueous solution of an alkali metal hypochlorite, an alkaline builder for maintaining a pH of at least 11 in the solution, and a hypochlorite-compatible surfactant, characterized by the cleaning composition being a fluid foam having, in combination, a precursor solution relative viscosity of no greater than 3, a synerisis value in the range of 2 to 40%, a foam horizontal thickness half-life of at least 12 minutes, and a vertical-surface clingability of at least 7 minutes.

2. A cleaning composition of claim 1 wherein the relative viscosity is in the range of 0.8 to 1.5, the syneresis value is in the range of 15 to 30%, the foam horizontal thickness half-life is at leas 15 minutes, and the vertical-surface clingability is at least 10 minutes.

3. A cleaning composition of claim 1 or 2 wherein the alkali metal hypochlorite is sodium hypochlorite that is present in the aqueous solution at a concentration in the range of 1 to 15%, the alkaline builder is sodium hydroxide or potassium hydroxide and the surfactant is a cocamine oxide, a sodium alkyl alkanoate or sodium dodecyl diphenyl disulfonate, that is present in the aqueous solution at a concentration in the range of 0.1 to 10%, and the solution optionally contains trisodiumphosphate and/or a hypochlorite-compatible fragrance.

4. A cleaning composition of claim 1 or 2 wherein the sodium hypochlorite concentration is in the range of 3 to 10%, and the surfactant concentration is in the range of 0.2 to 6%.

5. A cleaning composition of claim 3 wherein the solution also contains a calcium chelate of the disodium salt of ethylenediamine-tetraacetid acid dihydrate.

6. A process for preparing a cleaning composition fluid foam comprising the steps of (a) preparing an aqueous solution containing an alkali metal hypochlorite at a concentration in the range of 1 to 15%, a sodium hydroxide alkaline builder in a sufficient concentration to maintain the solution at a pH of at least 11, and a cocamine oxide surfactant or a sodium alkyl alkanoate surfactant or sodium dodecyl diphenyl disulfonate surfactant at a surfactant concentration in the range of 0.1 to 10%, and optionally trisodiumphosphate and/or a hypochlorite-compatible fragrance, (b) vigorously agitating the solution in the presence of a gas or propellant to form the foam.

7. A process of claim 6 wherein the vigorous agitation of the solution is performed with mechanical stirrers in the presence of air.

8. A process of claim 6 wherein the prepared solution loaded into an aerosol dispenser having a valve assembly, a mechanical breakup actuator and a push button actuator containing a dispenser outlet, a low-boiling hydrocarbon propellant is injected under pressure into the dispenser to form a mixture of solution and propellant, and the vigorous agitation is performed by passing the mixture through the mechanical break-up actuator.

9. A process of claim 8 wherein the propellant is propane, n-butane, isobutane or mixtures thereof, and amounts to 1 to 15% of the weight of the solution.

10. A process of claim 8 wherein the aerosol dispenser has an extension tube with an inlet end and exit end, the inlet end of the extension tube being connected to the outlet of the push button actuator and the mechanical break-up actuator being located in the exit end of the extension tube.

11. A process of claim 8 wherein the solution and the propellant are loaded into a pouch suspended within the dispenser, the pouch being separated from the container inner wall.

12. A process of claim 8 wherein the dispenser has a container and a cover, the container and cover being made of metal, the container having an inner liner insert of a hypochlorite-compatible polymer and the cover having laminated to its inner surface a layer of hypochlorite-compatible polymer.

* * * * *

UNITED STATES PATENT AND TRADEMARK OFFICE

CERTIFICATE OF CORRECTION

PATENT NO. : 6,756,352 B2
DATED : June 29, 2004
INVENTOR(S) : Munzer Makansi

It is certified that error appears in the above-identified patent and that said Letters Patent is hereby corrected as shown below:

Column 5,
Line 15, change “clearing” to -- cleaning --;
Line 55, after “such” insert -- as --;

Column 6,
Line 18, insert -- of -- before “stain-removing agents”;

Column 7,
Line 48, change “comopatible” to -- compatible --;

Column 12,
Line 33, insert -- of the -- before “foams”;

Column 13,
Line 54, change “ethylenediamine tetraacetid acid” to -- ethylenediamine tetraacetic acid --

Column 14,
Line 52, change “leas” to -- least --;

Column 15,
Line 3, change “ethylenediamine tetraacetid acid” to -- ethylenediamine tetraacetic acid --.

Signed and Sealed this

Twenty-third Day of November, 2004

JON W. DUDAS
*Director of the United States Patent and Trademark Office*